US010036972B1

(12) United States Patent
Iwasaki

(10) Patent No.: US 10,036,972 B1
(45) Date of Patent: Jul. 31, 2018

(54) CHARGER AND IMAGE FORMING APPARATUS

(71) Applicant: FUJI XEROX CO., LTD., Tokyo (JP)

(72) Inventor: Jin Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/663,899

(22) Filed: Jul. 31, 2017

(30) Foreign Application Priority Data

Mar. 23, 2017 (JP) ..... 2017-056967

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; G03G 15/0275; G03G 15/0225
See application file for complete search history.

(56) References Cited

U.S. PATENT DOCUMENTS 5,585,896 A * 12/1996 Yamazaki ..... G03G 15/0216 361/221
7,949,281 B2 * 5/2011 Muraishi ..... G03G 15/0225 399/100
8,064,791 B2 * 11/2011 Imaizumi ..... G03G 15/0233 399/100
8,204,400 B2 * 6/2012 Karasawa ..... G03G 15/025 399/100
8,218,997 B2 * 7/2012 Fujishiro ..... G03G 21/0058 399/100
2005/0191081 A1 * 9/2005 Muraishi ..... G03G 15/0225 399/100
2006/0067727 A1 * 3/2006 Suda ..... G03G 15/0225 399/100
2007/0292158 A1 * 12/2007 Matsumoto ..... G03G 15/0225 399/100
2008/0187360 A1 * 8/2008 Fujita ..... G03G 15/0225 399/176
2009/0087212 A1 * 4/2009 Ogura ..... G03G 15/0225 399/100
2009/0087213 A1 * 4/2009 Takaya ..... G03G 15/0225 399/100
2009/0180794 A1 * 7/2009 Tanaka ..... G03G 9/0819 399/100
2011/0069988 A1 * 3/2011 Kurita ..... G03G 15/0225 399/100
2015/0003873 A1 * 1/2015 Sato ..... G03G 15/0233 399/176

FOREIGN PATENT DOCUMENTS

JP 07-199595 A 8/1995
JP 07-219313 A 8/1995
JP 08-015962 A 1/1996
JP 2009244467 A * 10/2009

* cited by examiner

*Primary Examiner* — Sevan A Aydin
(74) *Attorney, Agent, or Firm* — Sughrue Mion, PLLC

(57) ABSTRACT

A charger includes a roller-shaped charging member and a contact width varying device. The charging member is in contact with a surface of an image holding member so as to charge the surface of the image holding member. The contact width varying device varies in an axial direction of the image holding member a contact width of the charging member with the image holding member so as to decrease uneven wear occurring in the axial direction of the image holding member.

19 Claims, 9 Drawing Sheets

| | FILM THICKNESS |
|---|---|
| END PORTIONS | 17 μm |
| CENTRAL PORTION | 16 μm |

| | FILM THICKNESS |
|---|---|
| END PORTIONS | 16 μm |
| CENTRAL PORTION | 20 μm |

CHARGER AND IMAGE FORMING APPARATUS

CROSS-REFERENCE TO RELATED APPLICATIONS

This application is based on and claims priority under 35 USC 119 from Japanese Patent Application No. 2017-056967 filed Mar. 23, 2017.

BACKGROUND

(i) Technical Field

The present invention relates to a charger and an image forming apparatus.

(ii) Related Art

In some related-art image forming apparatuses, a charging roller is in contact with a surface of a photosensitive drum so as to charge the surface of the photosensitive drum. In such image forming apparatuses, due to, for example, an uneven distribution of the pressure in the axial direction of a cleaning brush that removes adhering matter such as toner not having been transferred and remaining on the surface of the photosensitive drum, wear of the photosensitive drum tends to be promoted more at end portions than in a central portion in the axial direction. This tends to cause uneven wear.

Regarding the charging roller, in the case where an applied voltage is fixed, a divided voltage applied to a gap between the photosensitive drum and the charging roller is large when a film thickness of a photosensitive member is small. Accordingly, in the axial direction of the photosensitive member, the discharge amount increases in end portions compared to a central portion where the film thickness of the photosensitive member is relatively large. This promotes wear at the end portions due to stress caused by discharge.

A technique for pressing, when the charging roller is brought into contact with the surface of the photosensitive drum, the charging roller from its rear surface side toward the photosensitive drum in such image forming apparatuses has already been proposed.

SUMMARY

According to an aspect of the present invention, a charger includes a roller-shaped charging member and a contact width varying device. The charging member is in contact with a surface of an image holding member so as to charge the surface of the image holding member. The contact width varying device varies in an axial direction of the image holding member a contact width of the charging member with the image holding member so as to decrease uneven wear occurring in the axial direction of the image holding member.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

Exemplary Embodiment

Figure 1:
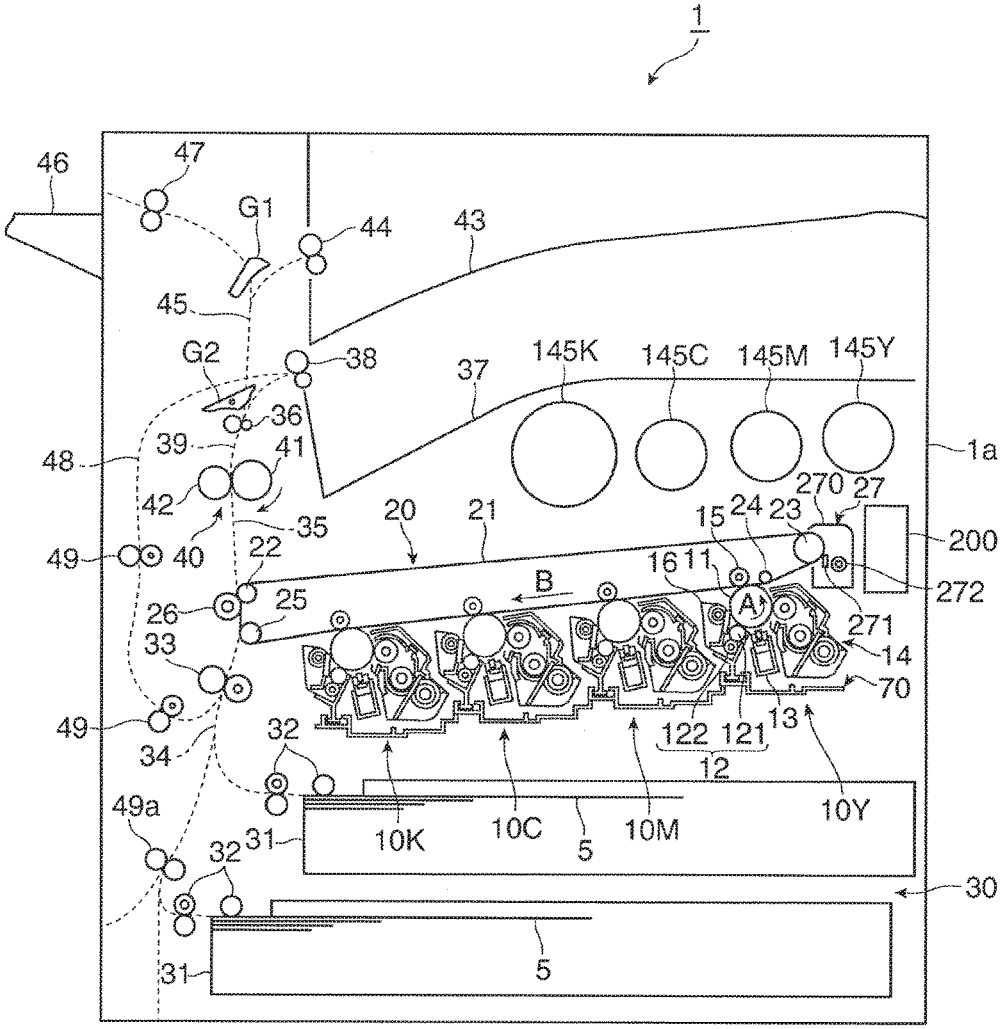
FIG. 1 is a schematic structural view of an image forming apparatus in which a charger according to an exemplary embodiment of the present invention is used.
Figure 2:
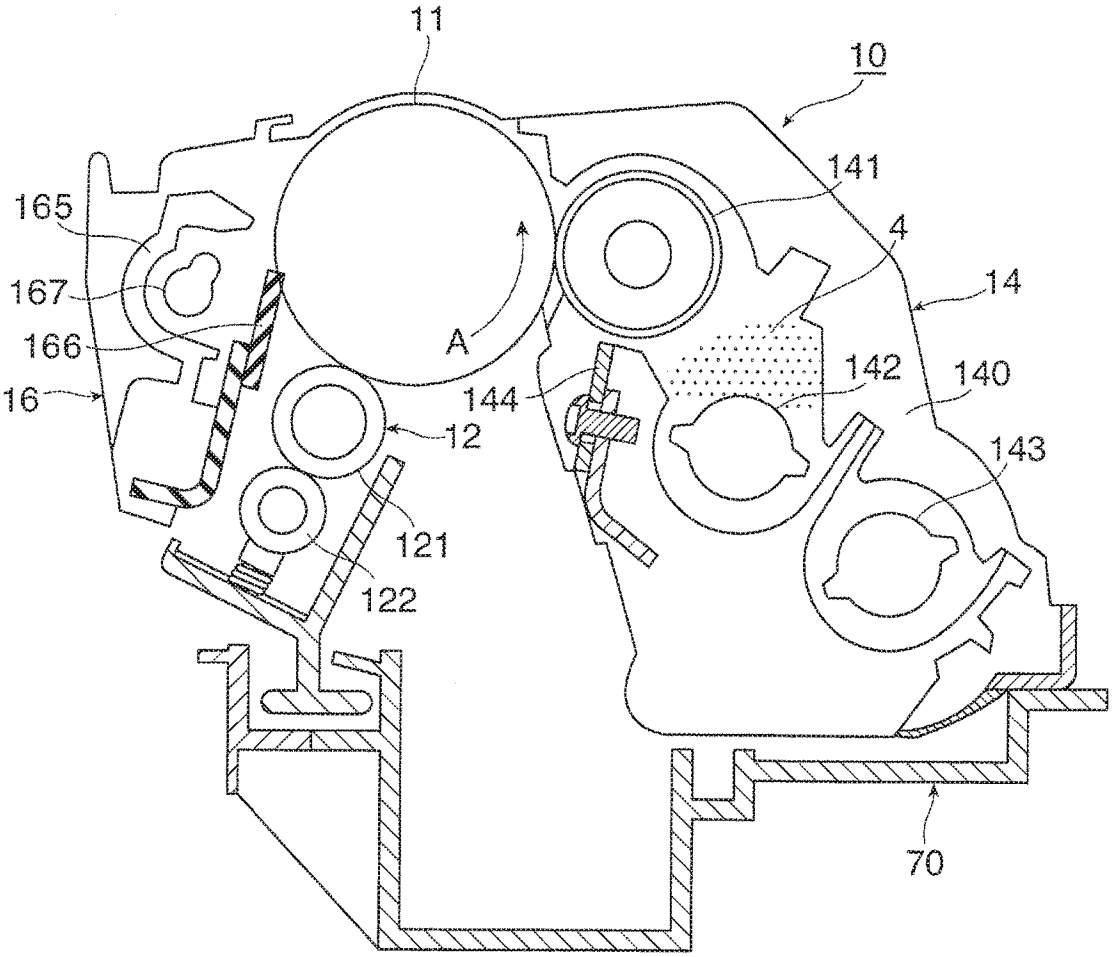
FIG. 2 is a structural view of an image forming unit of the image forming apparatus according to the exemplary embodiment of the present invention.

FIGS. 1 and 2 illustrate an image forming apparatus in which a charger according to the exemplary embodiment is used. FIG. 1 is a schematic overall view of the image forming apparatus. FIG. 2 is an enlarged view of parts (such as an image forming device) of the image forming apparatus.

An Overall Structure of the Image Forming Apparatus

An image forming apparatus 1 according to the exemplary embodiment is structured as, for example, a color printer. The image forming apparatus 1 includes plural image forming devices 10, an intermediate transfer device 20, a sheet feed device 30, a fixing device 40, and so forth. The image forming devices 10 form toner images developed with toner included in developer 4. The image forming devices 10 each serve as an example of an image forming unit. The intermediate transfer device 20 holds the toner images having been formed by the image forming devices 10 and transports the toner images to a second transfer position where the toner images are transferred through second transfer onto a recording sheet 5 at last. The recording sheet 5 serves as an example of a recording medium. Also, "recording sheet 5" is described in the plural form "recording sheets 5" where appropriate. The sheet feed device 30 contains and transports the required recording sheets 5 to be supplied to the second transfer position of the intermediate transfer device 20. The fixing device 40 fixes the toner images having been transferred through the second transfer by the intermediate transfer device 20 onto the recording sheet 5. Reference numeral 1*a* illustrated in FIG. 1 denotes an apparatus body of the image forming apparatus 1. This apparatus body 1*a* includes support structure members, an exterior covering, and so forth. Also in FIG. 1, dotted chain lines indicate transport paths through which the recording sheet 5 is typically transported in the apparatus body 1*a*.

The image forming devices 10 include four image forming devices 10Y, 10M, 10C, and 10K that each dedicatedly form a toner image of a corresponding one of four colors, that is, yellow (Y), magenta (M), cyan (C), and black (K). These four image forming devices 10Y, 10M, 10C, and 10K are arranged along an inclined line in an inner space of the apparatus body 1*a*. Out of four image forming devices 10Y, 10M, 10C, and 10K, the yellow (Y) image forming device 10Y is disposed at a relatively high position at an upper position in the vertical direction and the black (K) image forming device 10K is disposed at a relatively lower position in the vertical direction.

As illustrated in FIGS. 1 and 2, each of the four image forming devices 10Y, 10M, 10C, and 10K includes a corresponding one of rotating photosensitive drums 11. The rotating photosensitive drum 11 serves as an example of an image holding member. Devices included in a unit that serves as an example of a toner image forming section are typically disposed around the photosensitive drum 11 as follows. These devices include, for example, a charger 12 according to the present exemplary embodiment, a light exposure device 13, a developing device 14Y, 14M, 14C, or 14K, a first transfer device 15Y, 15M, 15C, or 15K, and a drum cleaner 16Y, 16M, 16C, or 16K. The charger 12 charges to a required potential a circumferential surface (image holding surface) of the photosensitive drum 11 on which an image formation is possible. The light exposure device 13 serving as an example of an electrostatic latent image forming unit radiates light in accordance with information (signal) of an image to the charged circumferential surface of the photosensitive drum 11 so as to form an electrostatic latent image (for a corresponding one of the colors) having a potential difference. The developing device 14 serving as an example of a developing section develops the electrostatic latent image with the toner of the developer 4 of a corresponding one of the colors (Y, M, C, and K) so as to form a toner image. The first transfer device 15 serving as an example of a first transfer unit transfers the toner image onto the intermediate transfer device 20. The drum cleaner 16 cleans the photosensitive drum 11 by removing adhering matter such as toner remaining on and adhering to the image holding surface of the photosensitive drum 11 after the first transfer has been performed. In FIG. 1, reference numerals for the photosensitive drums 11, the chargers 12, and so forth are indicated only for the yellow (Y) image forming device 10Y and those for the other image forming devices 10M, 10C, 10K are omitted.

The photosensitive drum 11 includes a grounded cylindrical or circular column-shaped base member. The image holding surface having a photoconductive layer (photosensitive layer) made of a photosensitive material is formed on a circumferential surface of the base member. This photosensitive drum 11 is supported such that the photosensitive drum 11 is rotated in an arrow A direction by a motive force transmitted from a drive device (not illustrated).

The charger 12 includes a contact-type charging roller disposed so as to be in contact with the photosensitive drum 11. The charger 12 also includes a cleaning roller 122 that cleans a surface of the charger 12. A charging voltage is supplied to the charger 12. In the case where the developing device 14 performs reversal development, a voltage or a current the polarity of which is the same as the polarity to which the toner supplied from this developing device 14 is charged is supplied as the charging voltage. The charger 12 will be described in detail later.

The light exposure device 13 includes a light-emitting-diode (LED) print head. The LED print head includes plural LEDs as light emitting elements arranged in the axial direction of the photosensitive drum 11 so as to radiate the light in accordance with image information to the photosensitive drum 11, thereby forming the electrostatic latent image. Alternatively, the light exposure device 13 may use laser light formed in accordance with the image information to perform deflection scanning in the axial direction of the photosensitive drum 11.

As illustrated in FIG. 2, each of the developing devices 14Y, 14M, 14C, and 14K includes, for example, a developing roller 141, two agitating and transport members 142 and 143, and a layer-thickness regulating member 144. These components are disposed in a housing 140 that has an opening and container chamber for the developer 4. The developing roller 141 holds the developer 4 and transports the developer 4 to a developing region facing the photosensitive drum 11. The agitating and transport members 142 and 143 include screw augers or the like and transport the developer 4 while agitating the developer 4 so that the developer 4 passes through the developing roller 141. The layer-thickness regulating member 144 regulates the amount (layer thickness) of the developer 4 held by the developing roller 141. A developing bias voltage is supplied between the developing roller 141 and the photosensitive drum 11 of the developing device 14 from a power unit (not illustrated). Furthermore, each of the developing roller 141 and the agitating and transport members 142 and 143 is rotated in a required direction by a motive force transmitted from a drive device (not illustrated). Furthermore, two-component developer that includes non-magnetic toner and magnetic carrier is used as the developer 4 of each of the four colors (Y, M, C, or K).

Each of the first transfer devices 15Y, 15M, 15C, and 15K is a contact-type transfer device that includes a first transfer roller. The first transfer roller is in contact with a circumference of the photosensitive drum 11 through an intermediate transfer belt 21 so as to be rotated. A first transfer voltage is supplied to the first transfer roller. As the first transfer voltage, a direct-current voltage the polarity of which is opposite to the polarity to which the toner is charged is supplied from a power unit (not illustrated).

As illustrated in FIG. 2, each of the drum cleaners 16 includes, for example, a body 165, a cleaning plate 166, and a feed member 167. The body 165 has a container shape and is partially opened. The cleaning plate 166 is disposed so as to be in contact at a required pressure with the circumferential surface of the photosensitive drum 11 having undergone the first transfer, thereby cleaning the circumferential surface of the photosensitive drum 11 by removing adhering matter such as residual toner. The feed member 167 that includes a screw auger or the like collects the adhering matter such as toner removed by the cleaning plate 166 and transports the adhering matter so as to feed the adhering matter to a collection system (not illustrated). A plate-shaped member (for example, blade) formed of, for example, rubber is used as the cleaning plate 166.

The cleaning plate 166 is fixedly mounted so that a distal end portion of the cleaning plate 166 is in contact with the circumferential surface of the photosensitive drum 11 at a required pressure by using an elastic member such as a coil spring or the like (not illustrated). A pressing force with which the cleaning plate 166 is in pressure contact with the circumferential surface of the photosensitive drum 11 typically tends to be, although it is also depending on a support structure of the cleaning plate 166, relatively large at both end portions and relatively small at a central portion in the axial direction of the photosensitive drum 11. Accordingly, wear of the photosensitive layer of the photosensitive drum 11 tends to be promoted more in the end portions than in the central portion in the axial direction. Thus, uneven wear is likely to occur.

As illustrated in FIG. 1, the intermediate transfer device 20 is disposed above the image forming devices 10Y, 10M, 10C, and 10K. The intermediate transfer device 20 includes, for example, the intermediate transfer belt 21, plural belt support rollers 22 to 25, a second transfer device 26, and a belt cleaner 27. The intermediate transfer belt 21 is rotated in an arrow B direction while passing through first transfer positions between the photosensitive drums 11 and the first transfer devices 15 (first transfer rollers). The intermediate transfer belt 21 is held in a desired state and rotatably supported from the inner circumferential side by the plural belt support rollers 22 to 25. The second transfer device 26 serving as an example of a second transfer unit is disposed on the outer circumferential surface (image holding surface) side of the intermediate transfer belt 21 at a position where the intermediate transfer belt 21 is supported by the belt support roller 22. The second transfer device 26 transfers through the second transfer the toner images on the intermediate transfer belt 21 onto the recording sheet 5. The belt cleaner 27 cleans the outer circumferential surface of the intermediate transfer belt 21 by removing adhering matter such as toner or paper dust remaining on and adhering to the outer circumferential surface of the intermediate transfer belt 21 after the intermediate transfer belt 21 has passed through the second transfer device 26.

The intermediate transfer belt 21 is an endless belt formed of a material including, for example, synthetic resin such as polyimide resin or polyamide resin in which a resistance adjuster or the like such as carbon black is dispersed. The belt support roller 22 serves as a rear surface support roller for the second transfer. The belt support roller 23 serves as a drive roller rotated by a drive device (not illustrated). The belt support roller 24 serves as a surface forming roller that forms an image forming surface of the intermediate transfer belt 21. The belt support roller 25 serves as a tension applying roller that applies tension to the intermediate transfer belt 21.

As illustrated in FIG. 1, the second transfer device 26 is a contact-type transfer device that includes a second transfer roller that is in contact with the circumferential surface of the intermediate transfer belt 21 so as to be rotated at the second transfer position which is part of the outer circumferential surface of the intermediate transfer belt 21 where the intermediate transfer belt 21 is supported by the belt support roller 22 of the intermediate transfer device 20. A second transfer voltage is supplied to the second transfer roller at the second transfer position. As the second transfer voltage, a direct-current voltage is supplied from a power unit (not illustrated) to the second transfer device 26 or the belt support roller 22 of the intermediate transfer device 20. The polarity of this direct-current voltage is opposite to or the same as the polarity to which the toner is charged.

As illustrated in FIG. 1, the belt cleaner 27 includes, for example, a body 270, a cleaning plate 271, and a feed member 272. The body 270 has a container shape and is partially opened. The cleaning plate 271 is disposed so as to be in contact at a required pressure with the circumferential surface of the intermediate transfer belt 21 having undergone the second transfer. The cleaning plate 271 disposed as described above cleans the circumferential surface of the intermediate transfer belt 21 by removing the adhering matter such as residual toner. The feed member 272 that includes a screw auger or the like collects the adhering matter such as toner removed by the cleaning plate 271 and transports the adhering matter so as to feed the adhering matter to a collection device (not illustrated). A plate-shaped member (for example, a blade) formed of, for example, rubber is used as the cleaning plate 271.

The fixing device 40 includes, for example, a heating rotating member 41 and a pressure rotating member 42 which are disposed in a housing (not illustrated) having an entrance and an exit for the recording sheet 5. The heating rotating member 41 is in the form of a roller or a belt, rotated in a direction indicated by an arrow, and heated by a heating unit so that the surface temperature of the heating rotating member 41 is maintained at a specified temperature. The pressure rotating member 42 is in the form of a belt or a roller and in contact at a specified pressure with the heating rotating member 41 substantially in the axial direction of the heating rotating member 41, thereby the pressure rotating member 42 is rotated. In this fixing device 40, a contact portion where the heating rotating member 41 and the pressure rotating member 42 are in contact with each other serves as a fixing process portion where the required fixing process (heating and applying pressure) is performed.

The sheet feed device 30 is disposed below the image forming devices 10Y, 10M, 10C, and 10K in the vertical direction. This sheet feed device 30 includes, for example, plural (or a single) sheet containers 31 and plural (or a single) feed devices 32. The sheet containers 31 each contain the stacked recording sheets 5 of a size, type, and so forth a user wishes to use. The feed devices 32 each feed one sheet after another from the recording sheets 5 contained in a corresponding one of the sheet container 31. The sheet container 31 is attached so as to, for example, allow the sheet container 31 to be drawn to the front side (side facing a user who operates the sheet container 31) of the apparatus body 1*a* using a guide rail (not illustrated). According to the present exemplary embodiment, a surface of the apparatus body 1*a* on the front side in a direction perpendicular to the page of FIG. 1 is the front surface of the apparatus body 1*a*.

Examples of the recording sheets 5 include, for example, plain paper used for electrophotographic copiers, printers, and so forth, thin paper such as tracing paper, and overhead projector (OHP) transparencies. In order to further improve smoothness of image surfaces after fixing, smoothness of the front side of the recording media 5 may be increased as much as possible. For example, coated paper made by coating the front side of plain paper with resin or the like, so-called cardboard such as art paper for printing having a comparatively large basis weight, and the like may also be used.

As illustrated in FIG. 1, a sheet feed transport path 34 is provided in the vertical direction between the sheet feed device 30 and the second transfer device 26 on the left side of the apparatus body 1*a*. The sheet feed transport path 34 is formed by a single or plural sheet transport roller pairs 33 and a transport guide (not illustrated). The sheet transport roller pair 33 or the sheet transport roller pairs 33 transport each of the recording sheets 5 fed from the sheet feed device 30 to the second transfer position. The sheet transport roller pair 33 or one of the sheet transport roller pairs 33 disposed at a position immediately upstream of the second transfer position in a sheet transport direction in the sheet feed transport path 34, serves as, for example, rollers that adjust timing at which the recording sheet 5 is transported (registration rollers). Furthermore, a sheet transport path 35 is provided between the second transfer device 26 and the fixing device 40. The recording sheet 5 having undergone the second transfer and fed from the second transfer device 26 is transported to the fixing device 40 through the sheet transport path 35. Furthermore, a first output transport path 39 and a second output transport path 45 are provided near an exit for the recording sheets 5 formed in the image forming apparatus body 1*a*. The first output transport path 39 is provided with a first sheet output roller pair 38 for outputting the recording sheet 5 having undergone fixing and fed from the fixing device 40 by an output roller 36 to a first sheet output section 37 in an upper portion of the image forming apparatus body 1*a*. The second output transport path 45 is provided with a second sheet output roller pair 44 for outputting the recording sheet 5 to a second sheet output section 43 positioned above the first sheet output section 37. The second output transport path 45 is also provided with a third sheet output roller pair 47 for outputting the recording sheet 5 advancing in a direction switched by a first switching gate G1 to a third sheet output section 46 on the left side surface of the image forming apparatus body 1*a*. The third sheet output section 46 includes a so-called face-up tray to which the recording sheet 5 is output with an image side facing upward.

A second switching gate G2 is provided between the fixing device 40 and the first sheet output roller pair 38. The second switching gate G2 switches the sheet transport path. The rotational direction of the first sheet output roller pair 38 is switchable between a forward direction (output direction) and a reverse direction. In order to form images on both sides of the recording sheet 5, the rotational direction of the first sheet output roller pair 38 is switched from the forward direction (output direction) to the reverse direction after a trailing end of the recording sheet 5 on one side of which an image had been formed has been passed through the second switching gate G2. The transport path of the recording sheet 5 transported in the reverse direction by the first sheet output roller pair 38 is switched by the second switching gate G2, so that this recording sheet 5 is transported to a duplex transport path 48 extending in the substantially vertical direction along the side surface of the image forming apparatus body 1*a*. The duplex transport path 48 is provided with sheet transport roller pairs 49, a transport guide (not illustrated), and so forth. The sheet transport roller pairs 49 transport the inverted recording sheet 5 to the sheet transport roller pair 33. Reference numeral 49*a* denotes a sheet transport roller pair that transports to the sheet transport roller pair 33 the recording sheet 5 fed from a manual feed tray (not illustrated) or the sheet container 31 or any of the sheet containers 31 disposed below the sheet transport roller pair 49*a*.

Referring to FIG. 1, reference numerals 145Y, 145M, 145C, and 145K denote toner cartridges. The toner cartridges 145 are each disposed in a direction perpendicular to the page of FIG. 1 and contain the developer 4 that includes at least the toner to be supplied to a corresponding one of the developing devices 14Y, 14M, 14C, and 14K.

Furthermore, reference numeral 200 of FIG. 1 denotes a controller that controls entire operation of the image forming apparatus 1. The controller 200 includes components and so forth (not illustrated) such as a central processing unit (CPU), a read only memory (ROM), a random access memory (RAM), buses through which these CPU, ROM, and so forth are connected, and a communication interface.

Operation of the Image Forming Apparatus

Basic image forming operation performed by the image forming apparatus 1 is described below.

Here, an operation in a full-color mode is described. In the full-color mode, a full-color image is formed by combining the toner images of four colors (Y, M, C, and K) by using four image forming devices 10Y, 10M, 10C, and 10K.

The image forming apparatus 1 is controlled by the controller 200. Upon reception of instruction information requesting a full-color image forming operation (printing) from a user interface (not illustrated), a printer driver (not illustrated), or the like, the image forming apparatus 1 starts four image forming devices 10Y, 10M, 10C, and 10K, the intermediate transfer device 20, the second transfer device 26, the fixing device 40, and so forth.

Consequently, in the image forming devices 10Y, 10M, 10C, and 10K, as illustrated in FIGS. 1 and 2, first, the photosensitive drums 11 are rotated in the arrow A direction, and the chargers 12 according to the present exemplary embodiment charge the surfaces of the respective photosensitive drums 11 to the required polarity (negative polarity according to the present exemplary embodiment) and the required potentials. Next, the light exposure devices 13 radiate the light emitted in accordance with image signals obtained by converting image information input to the image forming apparatus 1 into color components (Y, M, C, and K) to the surfaces of the charged photosensitive drums 11. Thus, the electrostatic latent images for the respective color components having the required potentials are formed on the surfaces of the photosensitive drums 11.

Next, the image forming devices 10Y, 10M, 10C, and 10K each supply the toner of a corresponding one of the colors (Y, M, C, and K) charged to the required polarity (negative polarity) from the developing roller 141 to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 is developed with the toner of the corresponding one of four colors (Y, M, C, and K) and becomes a visual toner image of the color.

Next, when the toner images of the colors formed on the photosensitive drums 11 of the image forming devices 10Y, 10M, 10C, and 10K are transported to the first transfer positions, the first transfer devices 15Y, 15M, 15C, and 15K transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10Y, 10M, 10C, and 10K where the first transfer has been performed. Thus, the image forming devices 10Y, 10M, 10C, and 10K are ready to perform the next image forming operation.

Next, the toner images having been transferred onto the intermediate transfer belt 21 through the first transfer are held by the intermediate transfer belt 21 and transported to the second transfer position by rotating the intermediate transfer belt 21 in the intermediate transfer device 20. Meanwhile, the sheet feed device 30 feeds the required recording sheet 5 to the sheet feed transport path 34 in accordance with the image forming operation. The recording sheet 5 is fed and supplied to the second transfer position by the sheet transport roller pair 33 serving as the registration rollers at timing adjusted to timing of the transfer in the sheet feed transport path 34.

The second transfer device 26 collectively transfers the toner images on the intermediate transfer belt 21 onto the recording sheet 5 through the second transfer at the second transfer position. Furthermore, the belt cleaner 27 cleans the surface of the intermediate transfer belt 21 by removing the adhering matter such as toner remaining on the surface of the intermediate transfer belt 21 after the second transfer has been performed in the intermediate transfer device 20 having undergone the second transfer.

Next, the recording sheet 5 onto which the toner images have been transferred through the second transfer is removed from the intermediate transfer belt 21 and then transported to the fixing device 40 through the sheet transport path 35. The recording sheet 5 having undergone the second transfer is introduced into and passes through the contact portion between the heating rotating member 41 being rotated and the pressure rotating member 42 being rotated so as to be subjected to a required fixing process (heating and applying pressure) in the fixing device 40. Thus, the unfixed toner images are fixed onto the recording sheet 5. At last, in the case of the image forming operation in which image formation is performed on only one of the sides of the recording sheet 5, the recording sheet 5 having undergone the fixing is output to, for example, the first sheet output section 37 provided in the upper portion of the apparatus body 1*a* by, for example, the first sheet output roller pair 38.

Through the above-described operation, the recording sheet 5 is output on which the full-color image or the full-color images made by combining the toner images of four colors have been formed. Of course, the image forming apparatus 1 may form a monochrome image or monochrome images on the recording sheet 5 only with the black (K) image forming device 10K.

A Structure of the Chargers

Figure 3:
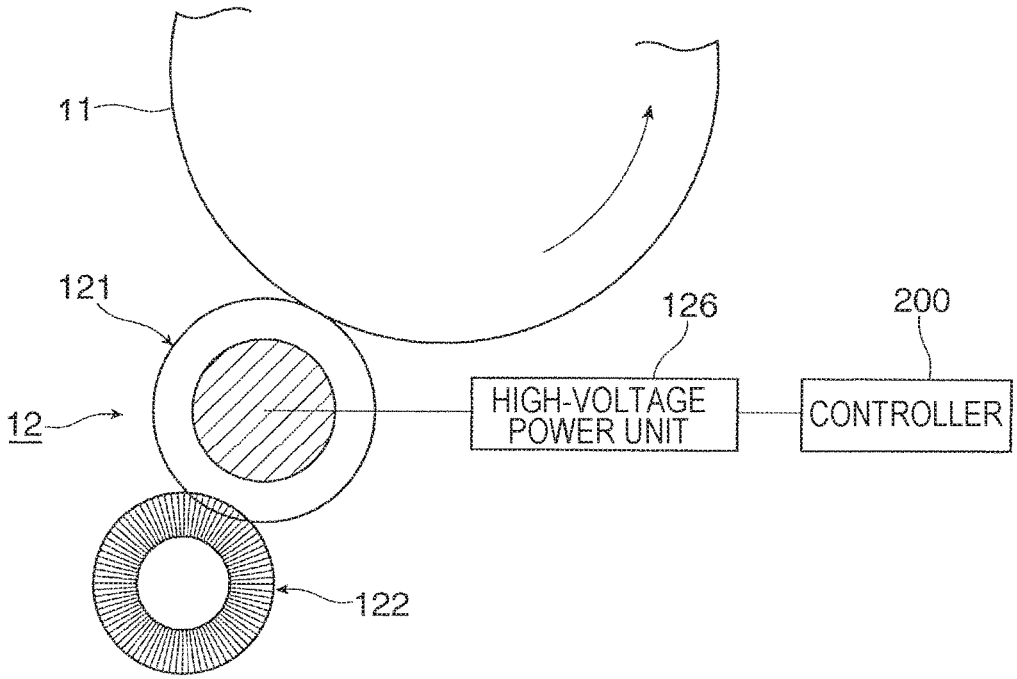
FIG. 3 is a structural view of the charger.
Figure 4:
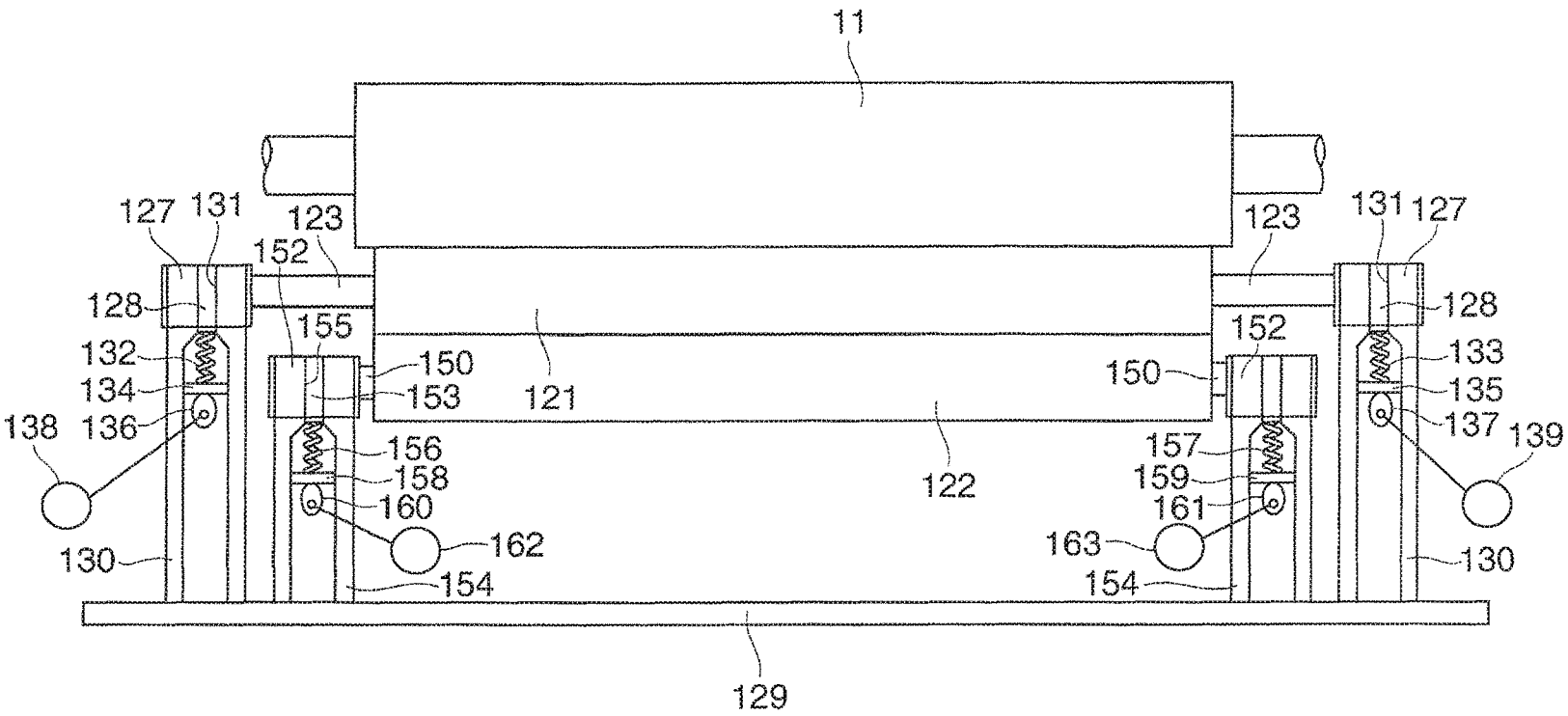
FIG. 4 is a structural view of a support structure of a charging roller.

FIGS. 3 and 4 are respectively a structural sectional view and a structural front view of one of the chargers according to the present exemplary embodiment.

As illustrated in FIGS. 3 and 4, each of the chargers 12 includes a charging roller 121 and the cleaning roller 122. The charging roller 121 serving as an example of a roller-shaped charging member is in contact with the circumferential surface of the photosensitive drum 11 serving as a charged body. The charging voltage is applied between the photosensitive drum 11 and the charging roller 121. The cleaning roller 122 serving as an example of a cleaning member is in contact with the circumferential surface of the charging roller 121 at a position where the charging roller 121 is not in contact with the photosensitive drum 11, thereby cleaning the surface of the charging roller 121.

Figure 5A:
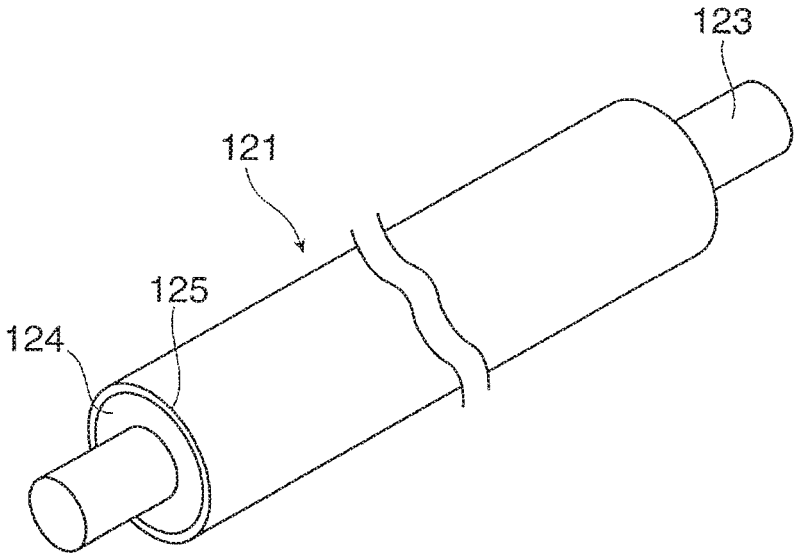
FIGS. 5A and 5B are structural views of the charging roller.
Figure 5B:
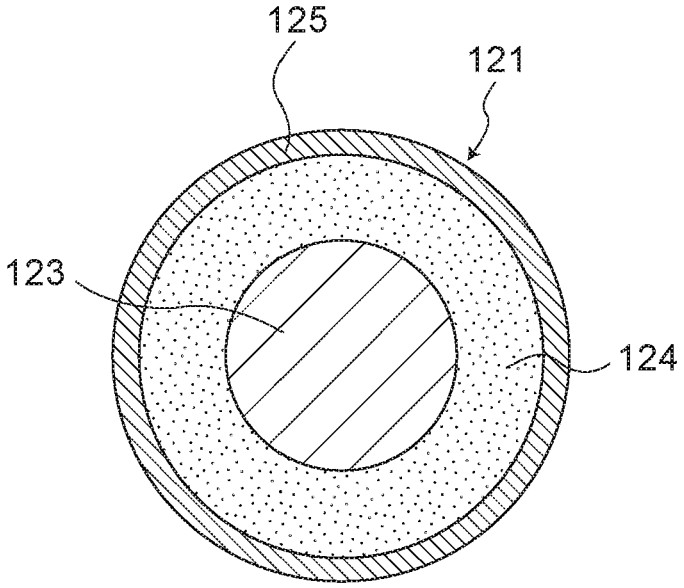

As illustrated in FIGS. 5A and 5B, the charging roller 121 includes a cored bar 123, an elastic layer 124, and a surface layer 125. The cored bar 123 has a circular column shape and is formed of metal such as stainless steel, steel, or the like. The elastic layer 124 is electrically conductive and coated to a required thickness over an outer circumference of the cored bar. The surface layer 125 is coated over the surface of the elastic layer 124. The cored bar 123 is provided so as to project from both end portions of the charging roller 121 in the axial direction. The cored bar 123 also functions as a rotational shaft.

Figure 6:
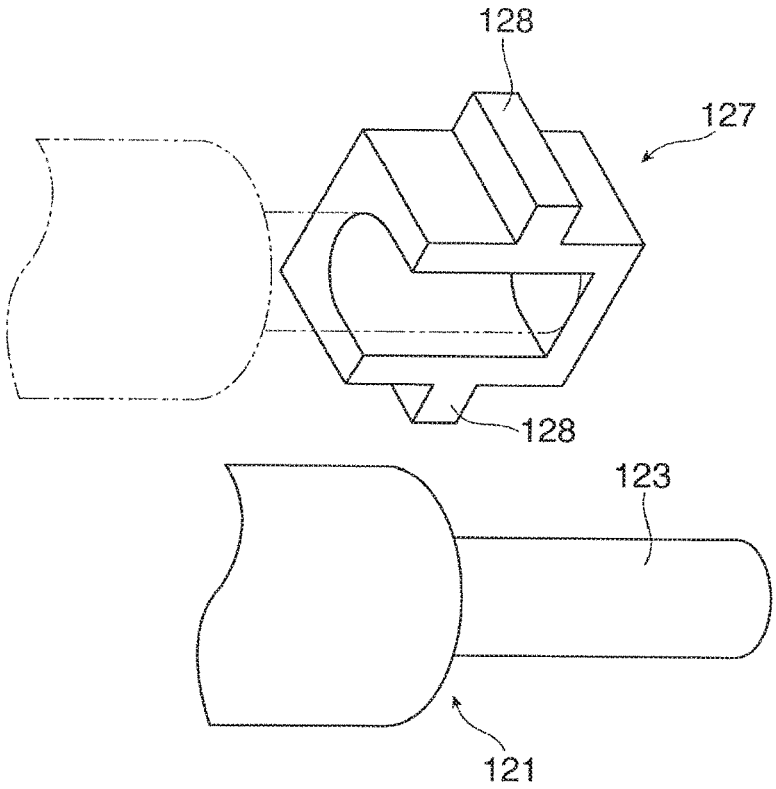
FIG. 6 is a structural perspective view of a bearing member of the charging roller.

As illustrated in FIG. 4, both the end portions of the cored bar 123 of the charging roller 121 in the axial direction are rotatably held by respective bearing members 127 having electrical conductivity. The bearing members 127 include slide bearings. Each of the bearing members 127 is a frame body having a substantially rectangular parallelepiped shape. An inner side surface of the bearing member 127 in the axial direction of the cored bar 123 of the charging roller 121 and a surface of the bearing member 127 facing the photosensitive drum 11 are open so as to form an inner space having the same radius of curvature as that of the outer diameter of the cored bar 123. As illustrated in FIG. 6, projections 128 are formed on respective side surfaces of the bearing member 127 in a direction intersecting the axial direction. With the projections 128, the bearing member 127 is held such that the bearing member 127 is movable in a direction in which the bearing member 127 approaches or separates from the photosensitive drum 11. As illustrated in FIG. 4, the projections 128 of the bearing member 127 are held by slits 131 of first guide members 130 provided in a housing 129 of the charger 12 such that the projections 128 are movable in a direction in which the bearing member 127 approaches or separates from the photosensitive drum 11. Furthermore, both the bearing members 127 of the charging roller 121 are urged by coil springs 132 and 133 serving as examples of an urging member so that the charging roller 121 is in contact with a required pressing force with the surface of the photosensitive drum 11. Furthermore, eccentric cams 136 and 137 provided at fixed positions in the housing 129 of the charger 12 are in contact with movable receiving plates 134 and 135. One end of each of the coil springs 132 and 133 is secured to a corresponding one of the movable receiving plates 134 and 135. The eccentric cams 136 and 137 are respectively rotated by first and second drive motors 138 and 139 controlled by the controller 200.

Furthermore, as illustrated in FIG. 3, the cored bar 123 of the charging roller 121 is connected to a high-voltage power unit 126 (an example of a voltage applying device) through the bearing members 127. The controller 200 controls a value and voltage application timing of a high voltage applied to the charging roller 121 by the high-voltage power unit 126.

The elastic layer 124 of the charging roller 121 is formed of, for example, a porous foam having cavities or projections/recesses in its inside or surface. The elastic layer 124 is formed of a material including a foamed resin material such as polyurethane, polyethylene, polyamide, olefin, melamine, or polypropylene or a foamed rubber material such as ethylene-propylene-diene copolymerization rubber (EPDM), acrylonitrile-butadiene copolymerization rubber (NBR), styrene-butadiene rubber, chloroprene rubber, silicone rubber, nitrile rubber, or natural rubber in which a resistance adjuster or the like such as carbon black or an ionic conductive agent is dispersed so as to obtain a required resistance. Alternatively, the elastic layer 124 may be a non-foamed solid rubber. Furthermore, the surface layer 125 of the charging roller 121 is provided by, for example, coating over an outer circumferential surface of the elastic layer 124 a material in which particulate filler is dispersed.

Alternatively, the charging roller 121 does not necessarily have the surface layer 125 other than the elastic layer 124.

Figure 7:
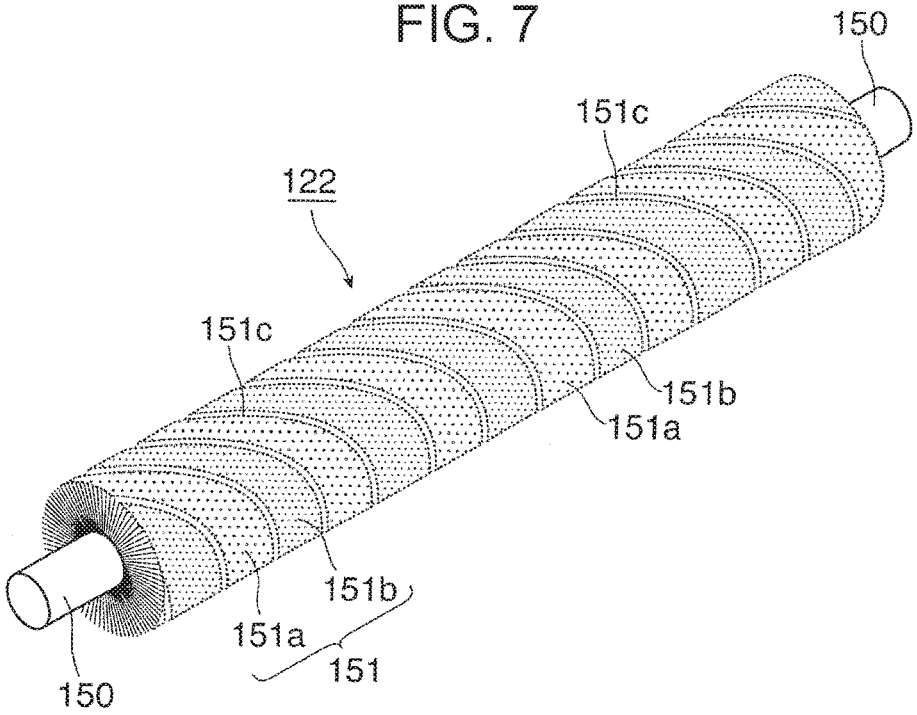
FIG. 7 is a structural perspective view of a cleaning roller.

The cleaning roller 122 cleans the surface of the charging roller 121. As illustrated in FIG. 7, the cleaning roller 122 includes a cored bar 150 and many (plural) brush hairs 151. The cored bar 150 serving as an example of a brush base portion is formed of metal such as stainless steel, steel, or the like. The brush hairs 151 are densely provided in an outer circumference of the cored bar 150 at a required density, and distal ends of the brush hairs 151 are in contact with the charging roller 121 serving as an object to be cleaned. In an illustrated example, the brush hairs 151 include first brush hairs 151*a* and second brush hairs 151*b* which are densely helically provided with gaps 151*c* disposed between the first brush hairs 151*a* and the second brush hairs 151*b*. Alternatively, the cleaning roller 122 may include, instead of brush hairs 151, for example, sponge that is helically wound on the outer circumference of the cored bar 150 or that has a cylindrical shape so as to surround the outer circumference of the cored bar 150. The cored bar 150 is provided so as to project from both end portions of the cleaning roller 122. The cored bar 150 also functions as a rotational shaft.

Figure 8:
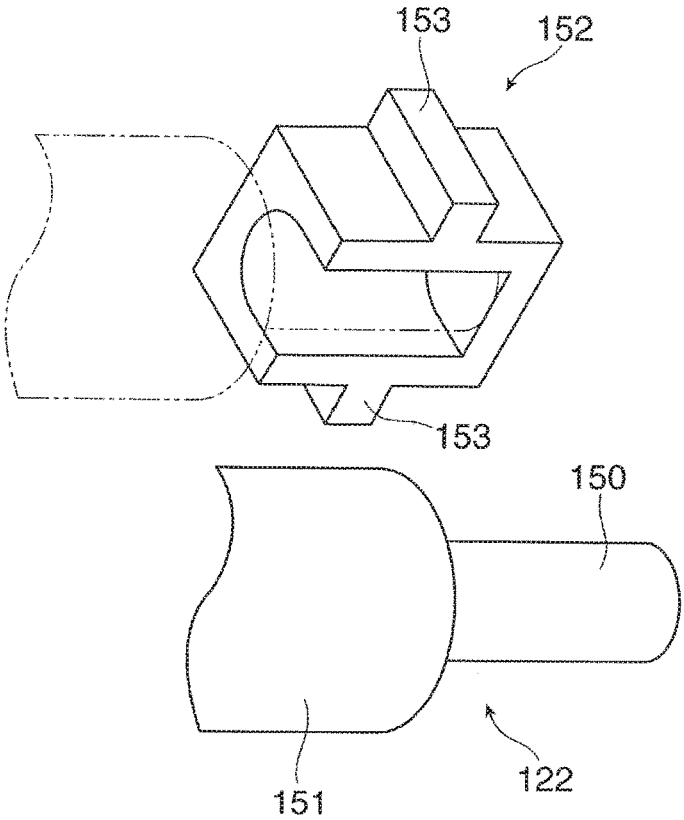
FIG. 8 is a structural perspective view of a bearing member of the cleaning roller.

As illustrated in FIG. 4, both the end portions of the cored bar 150 of the cleaning roller 122 in the axial direction are rotatably held by respective bearing members 152 having electrical conductivity. As illustrated in FIG. 8, the bearing members 152 include slide bearings. Each of the bearing members 152 is a frame body having a substantially rectangular parallelepiped shape. An inner side surface of the bearing member 152 in the axial direction of the cored bar 150 of the cleaning roller 122 and a surface of the bearing member 152 facing the charging roller 121 are open so as to form an inner space having the same radius of curvature as that of the outer diameter of the cored bar 150. Projections 153 are formed on respective side surfaces of the bearing member 152 in a direction intersecting the axial direction. With the projections 153, the bearing member 152 is held such that the bearing member 152 is movable in a direction in which the bearing member 152 approaches or separates from the photosensitive drum 11. As illustrated in FIG. 4, the projections 153 of the bearing member 152 are held by slits 155 of second guide members 154 provided in the housing 129 of the charger 12 such that the projections 153 are movable in a direction in which the bearing member 152 approaches or separates from the photosensitive drum 11. Furthermore, both the bearing members 152 of the cleaning roller 122 are urged by coil springs 156 and 157 serving as examples of an urging member so that the cleaning roller 122 is in contact with a required pressing force with the surface of the charging roller 121. Furthermore, eccentric cams 160 and 161 provided at fixed positions in the housing 129 of the charger 12 are in contact with movable receiving plates 158 and 159. One end of each of the coil springs 156 and 157 is secured to a corresponding one of the movable receiving plates 158 and 159. The eccentric cams 160 and 161 are respectively rotated by third and fourth drive motors 162 and 163 controlled by the controller 200.

For example, a required voltage may be applied to the cored bar 150 of the cleaning roller 122 through the bearing members 152, or the cored bar 150 may be connected to a ground through high resistance so as to be grounded or may be floated without being grounded.

The cleaning roller 122 is in contact with the surface of the charging roller 121 in the axial direction. The cleaning roller 122 may be rotated at an equal speed (circumferential speed) to that of the charging roller 121 through contact of the cleaning roller 122 with the surface of the charging roller 121 or may be rotated via a drive force transmission mechanism such as gears at a speed different from that of the charging roller 121.

The cleaning roller 122 includes, as described above, an elastic material such as brush hairs or sponge having a cylindrical shape so as to surround the outer circumference of the cored bar 150.

Referring to FIG. 4, according to the present exemplary embodiment, in order to decrease uneven wear occurring in the axial direction of the photosensitive drum 11, a contact width varying device that varies a contact width (nip width) of the charging roller 121 with the photosensitive drum 11 in the axial direction is provided.

The contact width varying device includes the coil springs 132 and 133, the eccentric cams 136 and 137, and the first and second drive motors 138 and 139 as described above. The coil springs 132 and 133 are each disposed at a corresponding one of the end portions of the charging roller 121 in the axial direction. The first and second drive motors 138 and 139 rotate the eccentric cams 136 and 137. The contact width varying device also includes the coil springs 156 and 157, the eccentric cams 160 and 161, and the third and fourth drive motors 162 and 163 as described above. The coil springs 156 and 157 are each disposed at a corresponding one of the end portions of the cleaning roller 122 in the axial direction. The third and fourth drive motors 162 and 163 rotate the eccentric cams 160 and 161.

Timing at which the first to fourth drive motors 138, 139, 162, and 163 are driven and rotating amounts of the first to fourth drive motors 138, 139, 162, and 163 are controlled by the controller 200.

In the charger 12, urging forces of the coil springs 132 and 133 are varied by rotating the eccentric cams 136 and 137 with the first and second drive motors 138 and 139. As a result, the contact width by which the charging roller 121 is in contact with the surface of the photosensitive drum 11 is varied in the axial direction.

Also in the charger 12, urging forces of the coil springs 156 and 157 are varied by rotating the eccentric cams 160 and 161 with the third and fourth drive motors 162 and 163. As a result, the pressing force with which the cleaning roller 122 presses the charging roller 121 against the photosensitive drum 11 is varied in the axial direction, thereby, the contact width by which the charging roller 121 is in contact with the surface of the photosensitive drum 11 is varied in the axial direction.

Operation of the Chargers

Upon input of a start signal of the image forming operation, the photosensitive drums 11 of the image forming devices 10Y, 10M, 10C, and 10K for yellow (Y), magenta (M), cyan (C), and black (K) are rotated as illustrated in FIG. 1 in the image forming apparatus 1 for which the charger according to the present exemplary embodiment is used. In each of the image forming devices 10Y, 10M, 10C, and 10K, the charging roller 121 charges the surface of the photosensitive drum 11 to a predetermined potential along with the start of the image forming operation.

After that, image light is radiated in accordance with the image information toward the surface of the photosensitive drum 11 by the light exposure device 13, thereby the electrostatic latent image is formed. The electrostatic latent image formed on the surface of the photosensitive drum 11 is visualized into a toner image by the developing device 14.

Next, when the toner images of the colors formed on the photosensitive drums 11 of the image forming devices 10Y, 10M, 10C, and 10K are transported to the first transfer positions, the first transfer devices 15Y, 15M, 15C, and 15K transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10Y, 10M, 10C, and 10K where the first transfer has been performed.

At this time, as illustrated in FIG. 2, each of the drum cleaners 16 removes the toner and the like remaining on the surface of a corresponding one of the photosensitive drum 11 such that the toner and the like are scraped off from the surface of the photosensitive drums 11 by bringing the cleaning plate 166 into contact with the circumferential surface of the photosensitive drum 11 at a required pressure. The pressing force with which the cleaning plate 166 is in pressure contact with the circumferential surface of the photosensitive drum 11 typically tends to be, although it is also depending on the support structure of the cleaning plate 166, relatively large at both the end portions and relatively small at the central portion in the axial direction of the photosensitive drum 11. Accordingly, wear of the photosensitive layer of the photosensitive drum 11 is promoted more in the end portions than in the central portion in the axial direction. Thus, uneven wear is likely to occur.

Figure 9:
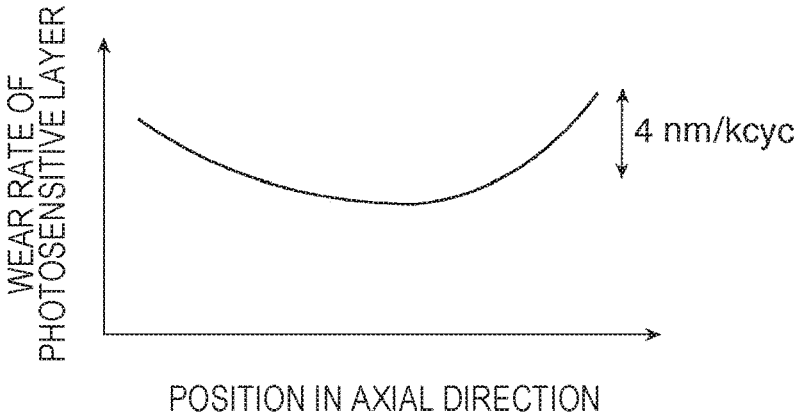
FIG. 9 is a graph illustrating uneven wear of a photosensitive drum.

FIG. 9 is a graph representing in the axial direction of the photosensitive drum 11 a wear rate of the photosensitive layer positioned on the surface of the photosensitive drum 11 when the photosensitive drum 11 is rotated 1 kcyc (1000 rotations) in a state in which the contact width by which the charging roller 121 is in contact with the photosensitive drum 11 is set to a normal value.

It has been found in a study that the wear rate of the photosensitive layer of the photosensitive drum 11 is higher by 4 nm per kcyc (1000 rotations) at the end portions than that at the central portion in the axial direction of the photosensitive drum 11.

In the case where the voltage applied by the high-voltage power unit 126 is fixed, a divided voltage applied to a gap between the photosensitive drum 11 and the charging roller 121 increases when the film thickness of a photosensitive layer of the photosensitive drum 11 is small. Accordingly, the discharge amount increases at the end portions compared to the central portion where the film thickness of the photosensitive drum 11 is relatively large. This promotes wear at the end portions in the axial direction of the photosensitive drum 11 due to stress caused by discharge. As a result, when measures are not taken against the uneven wear of the photosensitive layer of the photosensitive drum 11 as illustrated in FIG. 9, wear of the end portions in the axial direction of the photosensitive drum 11 is further more noticeable.

Thus, according to the present exemplary embodiment, in order to decrease uneven wear occurring in the axial direction of the photosensitive drum 11 as illustrated in FIG. 9, the contact width of the charging roller 121 with the photosensitive drum 11 is varied in the axial direction.

Figure 10:
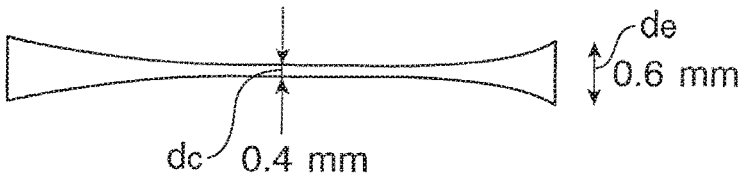
FIG. 10 is a schematic view of a contact width of the charging roller in a normal state.

In the normal state illustrated in FIG. 9, the contact width by which the charging roller 121 is in contact with the surface of the photosensitive drum 11 is, for example, as follows: as illustrated in FIG. 10, a contact width de at both the end portions in the axial direction of the photosensitive drum 11 is about 0.6 mm, and this value of the contact width de is relatively large compared to a contact width dc of about 0.4 mm at the central portion in the axial direction of the photosensitive drum 11.

Figure 11:
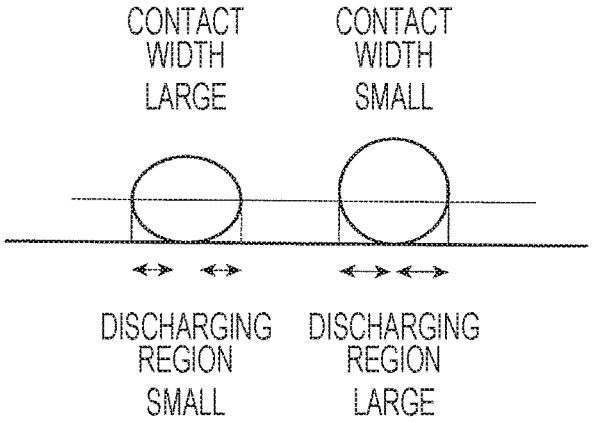
FIG. 11 is a schematic view of a discharging region in accordance with variation in the contact width of the charging roller.

When the contact width by which the charging roller 121 is in contact with the surface of the photosensitive drum 11 varies, wear of the photosensitive drum 11 tends to decrease or increase as follows: as illustrated in FIG. 11, when the contact width is large, a discharging region decreases, and accordingly, wear of the photosensitive drum 11 tends to decrease; and when the contact width is small, the discharging region increases, and accordingly, wear of the photosensitive drum 11 tends to increase.

Figure 12:
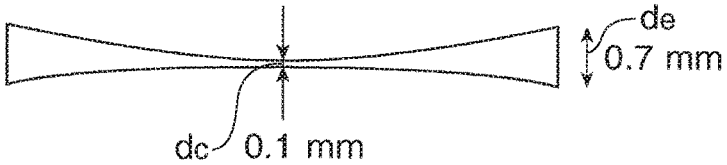
FIG. 12 is a schematic view of the contact width when the contact width of the charging roller is varied.

Thus, according to the present exemplary embodiment, for example, as illustrated in FIG. 12, the contact width varying device increases the contact width de at both the end portions in the axial direction of the photosensitive drum 11 to about 0.7 mm and decreases the contact width dc at the central portion in the axial direction of the photosensitive drum 11 to about 0.1 mm. Here, the contact width dc between the charging roller 121 and the photosensitive drum 11 at the central portion is set to such a value that is not zero, that is, set to such a value with which the charging roller 121 is not brought out of contact from the surface of the photosensitive drum 11.

Referring to FIG. 4, the contact width varying device increases the contact width, for example, as follows: the first and second drive motors 138 and 139 are rotated, thereby rotating the eccentric cams 136 and 137 so as to compress the coil springs 132 and 133. Accordingly, the contact width of the charging roller 121 with the photosensitive drum 11 is increased. Along with the above-described operation, with the contact width varying device, the third and fourth drive motors 162 and 163 are rotated, thereby rotating the eccentric cams 160 and 161 so as to decrease compressing forces of the coil springs 156 and 157. Accordingly, the pressure contact force of the cleaning roller 122 against the charging roller 121 is decreased.

Figures 13, 14A, 14B:
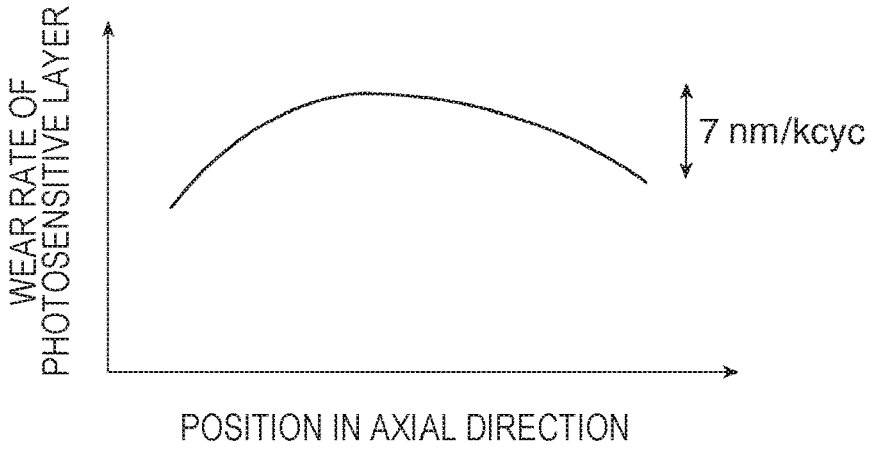
FIG. 13 is a graph illustrating the wear rate of a photosensitive member when the contact width of the charging roller is varied.
FIGS. 14A and 14B illustrate results of an experiment with an experimental example and a comparative example, respectively.

FIG. 13 is a graph representing in the axial direction of the photosensitive drum 11 a wear rate of the photosensitive layer positioned on the surface of the photosensitive drum 11 when the photosensitive drum 11 is rotated 1 kcyc (1000 rotations) in the following state: the pressure contact force of the charging roller 121 against the photosensitive drum 11 is increased and the pressure contact force of the cleaning roller 122 against the charging roller 121 is decreased by driving the contact width varying device as described above.

As clearly understood from FIG. 13, it has been found that the wear rate of the photosensitive layer of the photosensitive drum 11 is larger by 7 nm per kcyc (1000 rotations) at the central portion than that at both the end portions in the axial direction of the photosensitive drum 11.

According to the present exemplary embodiment, in the case where the charging roller 121 is in contact with the surface of the photosensitive drum 11 in the normal state when the surface of the photosensitive drum 11 is charged by the charging roller 121, wear in the axial direction of the photosensitive drum 11 is larger by about 4 nm/kcyc at both the end portions than that at the central portion in the axial direction of the photosensitive drum 11 as illustrated in FIG. 9.

In contrast, as illustrated in FIG. 12, in the state in which the contact width de at both the end portions in the axial direction of the photosensitive drum 11 is increased to about 0.7 mm and the contact width dc at the central portion in the axial direction of the photosensitive drum 11 is decreased to about 0.1 mm by controlling with the controller 200 the drive timing and the amounts of rotation of the first to fourth drive motors 138, 139, 162, and 163 so as to increase the pressure contact force of the charging roller 121 against the photosensitive drum 11 and decrease the pressure contact force of the cleaning roller 122 against the charging roller 121, conversely, wear is larger by about 7 nm/kcyc at the central portion than that at both the end portions in the axial direction of the photosensitive drum 11 as illustrated in FIG. 13.

According to the present exemplary embodiment, as has been described, the controller 200 controls the drive timing and the amounts of rotation of the first to fourth drive motors 138, 139, 162, and 163 so as to increase the pressure contact force of the charging roller 121 against the photosensitive drum 11 and decrease the pressure contact force of the cleaning roller 122 against the charging roller 121. However, according to the present exemplary embodiment, it is not necessary to vary the pressure contact forces of both the charging roller 121 and the cleaning roller 122. A configuration in which the pressure contact force of one of the charging roller 121 and the cleaning roller 122 is varied is possible. In more detail, the contact width varying device may vary the contact width with the photosensitive drum 11 so as to, without bringing the charging roller 121 out of contact from the photosensitive drum 11, increase the discharging region of the charging roller 121 toward the photosensitive drum 11 more in a region where wear of the photosensitive drum 11 is relatively small than in a region where wear of the photosensitive drum 11 is relatively large. Specifically, the contact width varying device may vary the contact width with the photosensitive drum 11 so that the discharging region of the charging roller 121 toward the photosensitive drum 11 is increased more at the central portion than at both the end portions in the axial direction of the photosensitive drum 11. This is able to be realized by, for example, providing a separate pressure roller that presses a central portion of the charging roller 121 or the cleaning roller 122 in the axial direction and moving the pressure roller in a direction in which the pressure roller is brought into contact with or brought out of contact from the charging roller 121 or the cleaning roller 122. Furthermore, the contact width varying device may vary the contact width with the photosensitive drum 11 so as to decrease the discharging region of the charging roller 121 toward the photosensitive drum 11 more in the region where wear of the photosensitive drum 11 is relatively large than in a region where wear of the photosensitive drum 11 is relatively small. In this case, the contact width varying device varies the contact width with the photosensitive drum 11 so that the discharging region of the charging roller 121 toward the photosensitive drum 11 is decreased more at both the end portions than at the central portion in the axial direction of the photosensitive drum 11.

Thus, according to the present exemplary embodiment, in order to decrease uneven wear occurring in the axial direction of the photosensitive drum 11, the contact width of the charging roller 121 with the photosensitive drum 11 is varied in the axial direction at required timing.

Specifically, the controller 200 measures a time period during which the charging roller 121 is in contact with the photosensitive drum 11 in a state as illustrated in FIG. 9 and a time period during which the charging roller 121 is in contact with the photosensitive drum 11 in a state as illustrated in FIG. 13. In accordance with this time measurement, the contact width between the charging roller 121 and the cleaning roller 122 is varied in a non-image-forming region so that the contact width of the charging roller 121 is decreased during a time period corresponding to 4/11.

Here, the numerator "4" corresponds to a wear-rate difference M1 of the photosensitive drum 11 in contact with the charging roller 121 in the normal contact state, and the denominator "11" corresponds to a total wear-rate difference M0 which is a total of the wear-rate difference M1 in the normal contact state and "7" which is a wear-rate difference M2 of the photosensitive drum 11 in a state where the contact width of the charging roller 121 is varied.

As described above, the wear-rate difference M2 of the photosensitive drum 11 in the state where the contact width of the charging roller 121 is larger than the wear-rate difference M1 in the normal contact state. Thus, the charging roller 121 is in contact with the photosensitive drum 11 in the normal contact state during the time period corresponding to the wear-rate difference M2 out of the total wear-rate difference M0. This may realize a substantially averaged wear rate of the photosensitive drum 11.

A charging time period of the charging roller 121 with the wear-rate difference M1 is set to T1 (=M2/M0) and a charging time period of the charging roller 121 with the wear-rate difference M2 is set to T2 (=M1/M0) by the controller 200. This allows the difference between the wear rates to be canceled out as follows:

$$M1 \times T1(=M2/M0)=M2 \times T2(=M1/M0).$$

Thus, according to the present exemplary embodiment, uneven wear occurring in the axial direction of the photosensitive drum 11 may be suppressed. This may suppress variation in charging in the axial direction of the photosensitive drum 11.

Experimental Example and Comparative Example

Next, an experiment is conducted with the image forming apparatus 1 as illustrated in FIG. 1 so as to check the wear rate of the photosensitive layer of the photosensitive drum 11.

In this experimental example, the image forming operation is stopped for three seconds every time images are formed on five A4-sized recording sheets 5 in the image forming apparatus 1. This intermittent operation is performed 2000 KPV. During the experiment, in a time period of 9.87 seconds from the start to the stop of an operation for forming the images on the five A4-sized recording sheets 5, the contact width of the charging roller 121 is controlled so that the contact width is as illustrated in FIG. 12 for a time period of 3.59 seconds corresponding to 4/11 of 9.87 seconds. In a comparative example, the contact width is kept in the normal state as illustrated in FIG. 10 without a time period during which the pressure between the charging roller 121 and the cleaning roller 122 is varied.

At this time, there are a cycle-in time period of 1 second which is a preparation time period before the image forming is started, a cycle-out time period of 1.8 seconds which is a finishing time period after the image forming, and four time periods between image regions (inter-image) of the recording sheets 5. Each of the time periods between the image regions (inter-image) is 0.6 seconds. Accordingly, the contact width between the charging roller 121 and the photosensitive drum 11 is varied during the 1-second cycle-in time period, the 1.8-second cycle-out time period, and 0.79 seconds out of the time periods between the image regions (the inter-image). The contact width is in the normal state during a time period other than the above-described time periods.

A distribution of the film thickness of the photosensitive drum 11 after 200 KPV images have been formed is, as illustrated in FIG. 14A, substantially flat other than the central portion where the film thickness is smaller than that at the end portions by 1 μm. In addition, defects such as unevenness in density of the images do not occur.

In the case of the comparative example without a time period during which the pressure between the charging roller 121 and the cleaning roller 122 is varied, a distribution of the film thickness of the photosensitive drum 11 after 200 KPV images have been formed is as follows: as illustrated in FIG. 14B, there occurs large uneven wear, that is, the end portions are smaller than the central portion by 4 μm. In addition, unevenness in density of the images occurs.

Although the full-color image forming apparatus that forms toner images of four colors, that is, yellow (Y), magenta (M), cyan (C), and black (K) is described as the image forming apparatus according to the present exemplary embodiment, of course, technologies described herein are similarly usable also for an image forming apparatus that forms monochrome images.

Furthermore, although the contact width varying device that includes the eccentric cams and drive motors combined with one another is described according to the present exemplary embodiment, it is not limiting. The contact width varying device may instead include solenoids or the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charger comprising:

a roller-shaped charging member that is in contact with a surface of an image holding member so as to charge the surface of the image holding member; and a contact width varying device that varies in an axial direction of the image holding member a contact width of the charging member with the image holding member so as to decrease uneven wear occurring in the axial direction of the image holding member.

2. The charger according to claim 1, wherein, without bringing the charging member out of contact from the image holding member, the contact width varying device decreases the contact width of the charging member with the image holding member more in a region where the wear of the image holding member is relatively small than in a region where the wear of the image holding member is relatively large.

3. The charger according to claim 2, wherein the contact width varying device decreases the contact width of the charging member more at a central portion than at both end portions in the axial direction of the image holding member.

4. The charger according to claim 1, wherein, without bringing the charging member out of contact from the image holding member, the contact width varying device varies the contact width with the image holding member in a region where the wear of the image holding member is relatively small so as to increase a discharging region of the charging member toward the image holding member more in the region where the wear of the image holding member is relatively small than in a region where the wear of the image holding member is relatively large.

5. The charger according to claim 4, wherein the contact width varying device varies the contact width with the image holding member so that the discharging region of the charging member toward the image holding member is increased more in a central portion than in both end portions in the axial direction of the image holding member.

6. The charger according to claim 1, wherein the contact width varying device increases the contact width of the charging member with the image holding member in a region where the wear of the image holding member is relatively large.

7. The charger according to claim 6, wherein the contact width varying device increases the contact width of the charging member more at both end portions than at a central portion in the axial direction of the image holding member.

8. The charger according to claim 1, wherein the contact width varying device varies the contact width with the image holding member in a region where the wear of the image holding member is relatively large so that a discharging region of the charging member toward the image holding member is decreased more in the region where the wear of the image holding member is relatively large than in a region where the wear of the image holding member is relatively small.

9. The charger according to claim 8, wherein the contact width varying device varies the contact width with the image holding member so that the discharging region of the charging member toward the image holding member is decreased more in both end portions than in a central portion in the axial direction of the image holding member.

10. The charger according to claim 1, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

11. The charger according to claim 2, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

12. The charger according to claim 3, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

13. The charger according to claim 4, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

14. The charger according to claim 5, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

15. The charger according to claim 6, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

16. The charger according to claim 7, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

17. The charger according to claim 8, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

18. The charger according to claim 9, further comprising:

a cleaning member that is in contact with a surface of the charging member in an axial direction so as to clean the charging member, wherein the contact width varying device varies the contact width by varying at least one of a contact pressure of the charging member against the image holding member and a contact pressure of the cleaning member against the charging member.

19. An image forming apparatus comprising:

a charging device that charges a surface of an image holding member;

an electrostatic latent image forming unit that forms an electrostatic latent image on the surface of the image holding member charged by the charging device; and a developing section that develops the electrostatic latent image formed on the surface of the image holding member by the electrostatic latent image forming unit, wherein the charger according to claim 1 is used as the charging device.

* * * * *